US005944308A

United States Patent [19]

McLeod et al.

[11] Patent Number: 5,944,308

[45] Date of Patent: Aug. 31, 1999

[54] PINCH-PROOF EDGE GUIDE

[75] Inventors: Kevin James McLeod, Dunnellon, Fla.; Edward Alan Rush; Scott Stephen Williams, both of Lexington, Ky.

[73] Assignee: Lexmark International, Inc., Lexington, Ky.

[21] Appl. No.: 08/914,936

[22] Filed: Aug. 20, 1997

[51] Int. Cl.[6] ..... B65H 1/00

[52] U.S. Cl. ..... 271/171; 271/145

[58] Field of Search ..... 271/171, 223, 271/253, 254, 145; 400/632.1, 633.2, 633; 399/393

[56] References Cited

U.S. PATENT DOCUMENTS

| | | | |
|---|---|---|---|
| 1,987,803 | 1/1935 | Ryan | 271/61 |
| 3,957,366 | 5/1976 | Taylor et al. | 355/3 R |
| 4,343,461 | 8/1982 | Tomimori et al. | 271/22 |
| 4,772,007 | 9/1988 | Kashimura | 271/171 |
| 4,908,673 | 3/1990 | Muramatsu | 271/171 |
| 5,803,631 | 9/1998 | Bingham et al. | 271/223 |

FOREIGN PATENT DOCUMENTS

| | | | |
|---|---|---|---|
| 0117137 | 5/1989 | Japan | 271/171 |
| 404023779 | 1/1992 | Japan | 271/171 |
| 404323141 | 11/1992 | Japan | 271/171 |

OTHER PUBLICATIONS

Lee et al, Low Cost Paper Aligner, IBM Technical Disclosure Bulletin vol. 22 No. 12 May 1980, p. 5228.

*Primary Examiner*—H. Grant Skaggs
*Attorney, Agent, or Firm*—John A. Brady

[57] ABSTRACT

A paper tray or fixed platform for loading paper includes an adjustable edge guide including a primary paper guide surface and a cantilever portion including an end surface, the end surface movable between retracted and extended positions, so that when the end surface is disposed in its extended position and the edge guide is moved to bring the end surface in contact with a supply of paper, the primary paper guide surface is sufficiently spaced away from the supply of paper to avoid paper pinching and excessive clearance conditions. The edge guide is molded as one piece with a living hinge, removed from the mold while warm, and a pin is inserted to prevent the cantilever portion from warping toward the guide surface during cooling.

14 Claims, 5 Drawing Sheets

PINCH-PROOF EDGE GUIDE

FIELD OF THE INVENTION

The present invention relates generally to paper source assemblies, e.g., for devices such as printers, copiers and the like, including one or more adjustable guides used to help locate a supply of paper within the device. More specifically, the present invention is directed to a computer printer platform for loading paper or a removable paper tray including an adjustable side edge guide having a flexible cantilever portion adapted for forming a temporary edge guide surface for use in adjusting the side edge guide relative to the supply of paper. As the paper supply is positioned, the temporary edge guide surface and movement of the cantilever portion of the side edge guide effectively space the side edge guide from the paper to avoid undesirable effects during printer operation, such as paper pinching, skew and the like.

BACKGROUND OF THE INVENTION

In printers and copiers, proper image registration on a page depends upon the correct positioning of the paper within the device. One aspect of paper positioning involves the location of the paper supply within the paper source assembly for the device. The two primary types of paper source assemblies are the removable paper tray and the fixed platform for paper loading. Those paper source assemblies often are used in computer printers and personal copiers. Other paper source assemblies also are known, such as the non-removable drawer-type assembly, which typically is used in larger size copiers and printers. The present invention is suitable for use with these and other types of paper source assemblies, with other means for receiving a supply of printable media, and with media other than paper. However, for convenience, reference is made herein only to the preferred embodiment of the present invention in exemplary applications involving paper and a removable paper tray or fixed platform.

In most types of paper source assemblies or devices, some form of side guide generally is used to help locate the paper in the source. Typically, paper in a removable tray is in the form of a stack of up to 500 individual sheets of paper in either letter (8½ in. by 11 in.) or legal (8½ in. by 14 in.) size. A fixed platform generally holds up to 100 of such sheets. However, because other size papers may be used, e.g., A4 paper, or because it may be desirable in some applications to feed various sized media (other than paper) into the printer or copier, e.g., cardstock, transparencies, labels or envelopes, the use of adjustable side guides in paper source assemblies generally is preferred.

One problem associated with the function and operation of paper source assemblies including adjustable side guides is paper pinching. In general, paper pinching results from the positioning of a side guide either adjacent to or too close to a supply of paper. Such a condition might result, for example, from an operator moving a side guide too close to a stack of paper, or from an inability of a paper side guide to accommodate the natural variations in the size of paper from load to load due to, e.g., changing environmental effects and/or the tolerances associated with the manufacture of the paper.

The adverse effects created by paper pinching are significant in terms of the overall operation of the printer or copier. Performance differences can be measured between systems having pinched and unpinched paper sources. Paper skew may be caused by a pinching condition, meaning that ultimately an image may not be properly placed on a page.

Pinching also may cause the paper to feed incorrectly, perhaps resulting in a paper jam and/or damage to the machine.

In edge driven systems in particular, in which the paper is fed against a single reference edge that keeps the paper straight all the way through the machine, it is important to avoid the effects of paper pinching. The feed accuracy of the downstream edge driven paper transport system depends upon the drag forces that must be overcome with a particular paper source assembly and edge guide system. Such systems "pull" on only one side of the paper (along the reference edge); thus, if an edge guide provides a frictional drag on the paper, the paper will tend to turn off of its reference edge and travel crooked through the printer, preventing accurate image registration. Moreover, such adverse effects of paper pinching are greatly amplified by the degrees of wrap which the paper goes through in edge driven systems in which the paper travels in a serpentine path.

Most paper source assemblies have at least some limited ability to adjust to various paper sizes. For example, there are three commonly used mechanisms for adjusting the position of side guides in removable paper trays and fixed platforms: fixed detents, a rack and pawl, and a frictional system. In fixed detent systems, the side guides typically include pins that drop into holes in the paper tray or platform to lock the side guide in place. One or more holes are placed at predetermined locations so that the side guides will be positioned to fit various size sheets of paper. Accordingly, the fixed detent system is not universally adjustable to accommodate odd-sized media. The side guides are positioned without regard to possible variations in the actual size of the paper used. Thus, a significant drawback of fixed detents results in part from the paper tolerances associated with the manufacture of the paper, and from paper shrinkage and growth due variable humidity levels. This requires that a nominal clearance of up to 4 mm or more be maintained between the fixed detent and the paper to prevent pinching of the paper, which in turn often results in less than desirable registration accuracy and poor repeatability from load to load due to there being too much or too little gap between the edge guide and the paper.

The second type of side guide adjustment mechanism is a "rack and pawl" system. In such systems the side edge guides typically include a "pawl" or other extension operatively coupled to a rack having a plurality of teeth along its length that define a number of locking positions for the side guide. Thus, this guide system is similar to, but allows greater freedom of adjustment than, fixed detent systems. However, accuracy of side guide adjustment still remains limited by the pitch of the teeth on the rack (typically on the order of 1–2 mm), and although rack-type edge guides allow for better paper constraining, they too are susceptible to paper pinching as described above.

A frictional side guide adjustment system allows the greatest level of freedom in terms of side guide positioning. However, paper pinching remains a problem in these systems too, mainly due to operator error in adjusting the guide too close to the paper supply. Accordingly, with prior paper source assemblies including adjustable side guides there remains a need for an effective means of reducing the problems associated with paper pinching and excessive clearance.

SUMMARY OF THE INVENTION

The present invention overcomes the above-noted and other shortcomings of prior paper source assembly systems by providing a means to adjust effectively the side edge guides of removable paper trays and fixed platforms for paper loading, so as to accommodate various size paper and other media, while at the same time avoid the problems associated with prior systems. In accordance with the present invention, a means is provided for accurately setting an appropriate clearance between a supply of paper and an edge guide, so as to avoid paper pinching, which may cause paper feed problems, and excessive clearance, which may cause paper alignment problems. A paper source device is provided comprising a platform or tray, and an adjustable side edge guide operatively coupled to the platform or tray. The platform or tray is adapted to receive a supply of paper. The adjustable side edge guide includes a primary edge guide surface and a flexible cantilever portion which an operator may move to form a temporary edge guide surface for use in adjusting the side edge guide relative to the supply of paper. Specifically, once a supply of paper is situated on the platform or tray, a temporary edge guide surface is formed between the edge of the supply of paper and the primary edge guide surface by the movement of the flexible cantilever portion from a first, retracted position to a second, extended position. The temporary edge guide surface is maintained while the adjustable side edge guide is brought as near as possible to the supply of paper. Preferably, the side edge guide is moved to the position in which the temporary edge guide surface contacts the edge of the paper supply. The flexible cantilever portion then is moved to its first, retracted position, leaving the primary edge guide surface preferably spaced between about 1 mm and about 2 mm from the edge of the supply of paper.

The adjustable side edge guide including the flexible cantilever portion preferably is of single piece construction, so that the flexible cantilever portion comprises a "living hinge." Alternatively, the adjustable side edge guide may include a first portion including a primary edge guide surface and a second portion including an end surface which serves as the temporary edge guide surface when the second portion is in an extended position. In such alternate embodiment the first and second portions are coupled so that the end surface is movable between the first, retracted position (in which the end surface is not closer to the edge of the paper supply than the primary edge guide surface) and a second, extended position (in which the end surface is closer to the edge of the paper supply than the primary edge guide surface). Preferably, said first and second portions are hinged, and a spring or spring-like material is operatively coupled to each of said portions, so that the second portion naturally tends to assume its first, retracted position.

A one piece molded part as the side edge guide is preferred in which the guide is removed from the mold while significantly warm and a blocking member is inserted to prevent warp of the cantilever member during cooling.

DETAILED DESCRIPTION OF THE INVENTION

Figure 1:
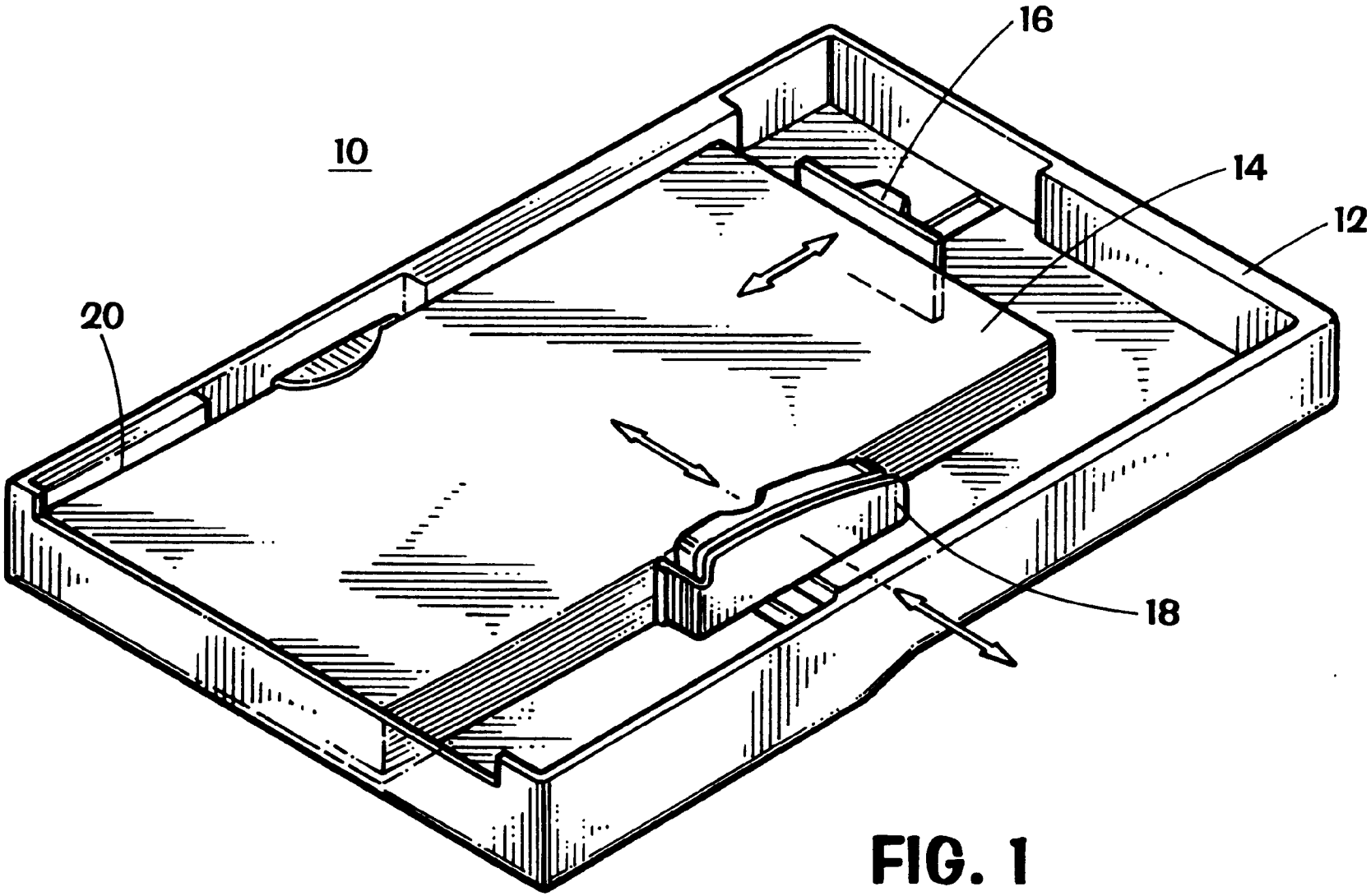
FIG. 1 is an illustration of an exemplary computer printer paper tray including a side edge guide in accordance with the present invention.

In accordance with the present invention, as shown in FIG. 1, a paper source assembly 10 comprises a tray 12 in which a supply of paper 14 is located. Operatively coupled to the tray 12 are end guide 16 and side guide 18, which help to locate the paper supply 14 within the tray 12. Preferably, the end guide 16 and side guide 18 slidably engage the tray 12 and comprise adjustable side guides of either the "frictional" or "rack and pawl" type as described herein, so that end guide 16 and side guide 18 are movable away from or toward the paper supply 14. As shown in the drawing, the paper supply 14 is aligned on one side adjacent to a reference edge 20, with the side guide 18 disposed generally opposite the reference edge 20.

Although reference is made herein to an embodiment of the present invention comprising a side guide for a paper source assembly, the present invention also may be used in connection with other applications, such as end guides of the type shown in FIG. 1. In fact, the exact size, shape, location, etc. of the means for establishing a clearance between a surface and supply of media in accordance with the present invention will depend upon the circumstances involved in a particular desired application.

Figure 2:
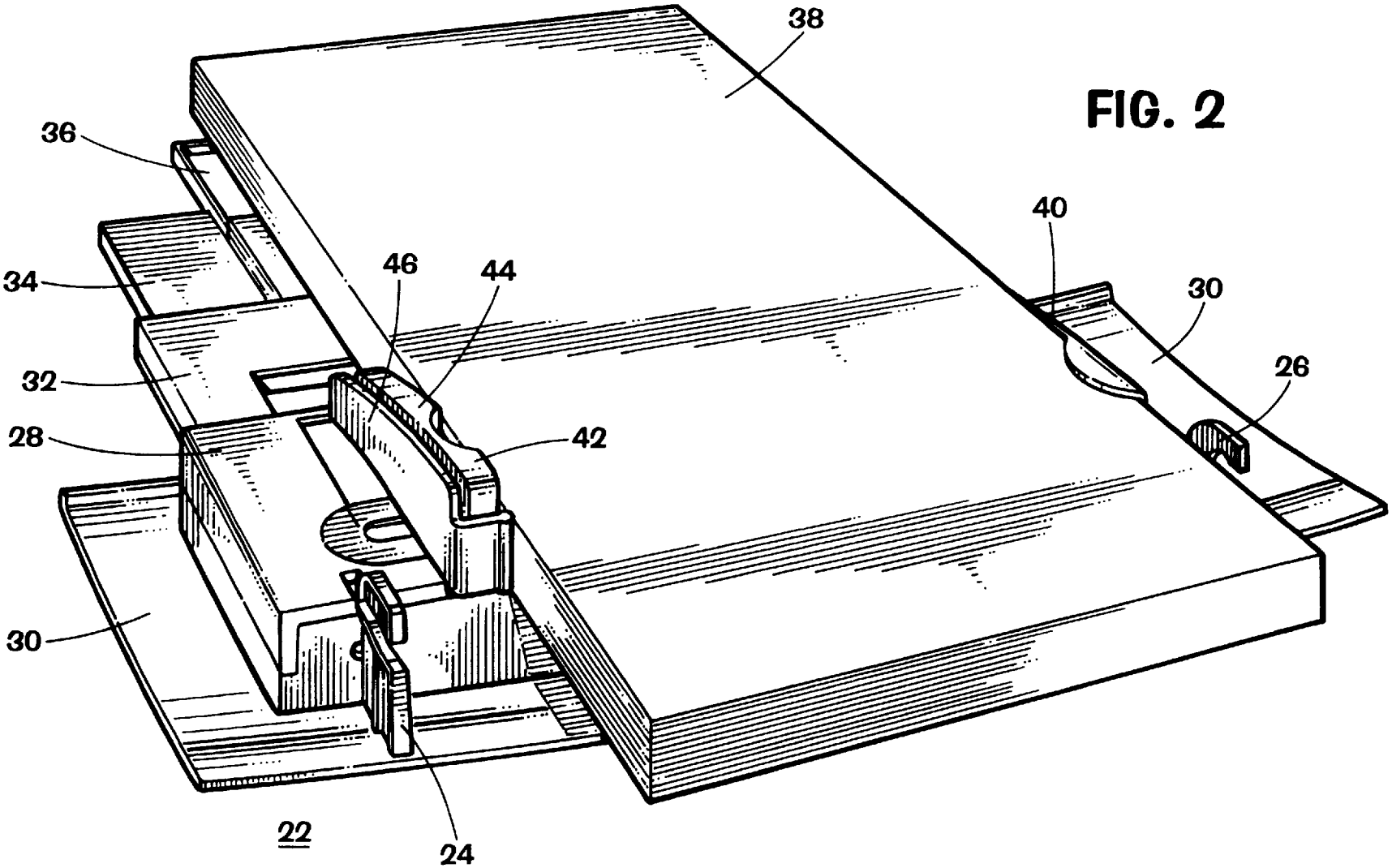
FIG. 2 is an illustration of an exemplary fixed platform for paper loading including a side edge guide in accordance with the present invention.

FIG. 2, for example, illustrates an exemplary application of the present invention involving a fixed platform 22 for paper loading. The fixed platform 22 includes a pair of hinge supports 24, 26 for connecting the fixed platform 22 to a computer printer or copier (not shown). The main body 28 of the fixed platform 22 is coupled to a door or cover 30 preferably of a style, design and shape matching that of the printer or copier to which it connects. The main body 28 of the fixed platform 22 also is operatively coupled to a plurality of support extensions 32, 34, 36. The support extensions 32, 34, 36 preferably nest together and are in sliding engagement along the direction in which the supply of paper 38 is fed into the copier or printer. The support extensions may serve to provide a base for the supply of paper 38. The paper supply 38 preferably is aligned at one side along a reference edge 40. Generally disposed opposite reference edge 40 is a side guide 42 in accordance with the present invention.

Figure 4:
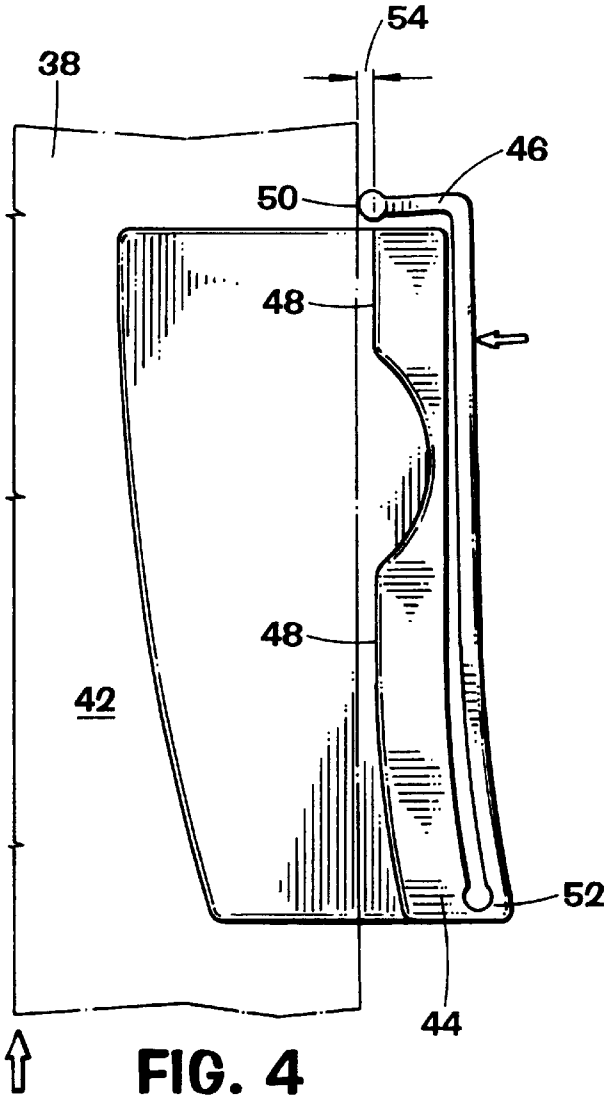
FIG. 4 is an illustration of the exemplary edge guide of FIG. 3, with the flexible cantilever portion shown in an extended position.
Figure 3:
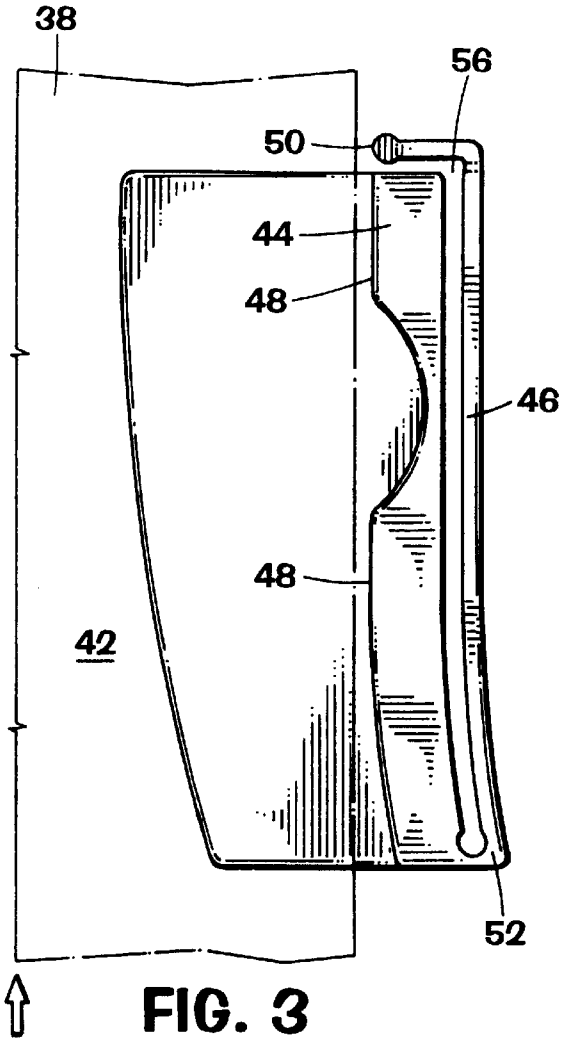
FIG. 3 is an illustration of an exemplary edge guide in accordance with the present invention including a flexible cantilever position shown in a retracted position.

The side guide 42, features of which are shown in greater detail in FIGS. 3 and 4, preferably slidably engages the main body 28 of fixed platform 22, and comprises an adjustable side guide of either the frictional or rack and pawl type as described herein. The side guide 42 comprises a first portion 44 and a second portion 46. The first portion 44 of side guide 42 includes a primary edge guide surface 48 which, in accordance with the present invention, and as shown in FIG. 3, is spaced away from the edge of the supply of paper 38 during operation of the printer or copier. Preferably, the primary edge guide surface 48 is spaced between about 1 mm to about 2 mm from the edge of the paper supply 38. The second portion 46 of side guide 42 includes an end surface 50 which serves as a temporary edge guide surface used in obtaining the desired spacing between the primary edge guide surface 48 and the paper supply 38. As shown in FIGS.

3 and 4, the side guide 42 preferably is of single piece construction, with first portion 44 and second portion 46 being joined by a living hinge 52. The second portion 46 thus comprises a flexible cantilever member, and the end surface 50 is movable through a distance 54, shown in FIG. 4, between a first, retracted position (see, e.g., FIG. 3) and a second, extended position (see, e.g., FIG. 4).

As shown in the drawings, the magnitude of the distance 54 is determined by the width of the gap 56 between first portion 44 and second portion 46 of side guide 42. However, the exact locations of the retracted and extended positions of end surface 50 may vary from application to application depending upon the width of the gap 56 and the shape and length of the endmost part of second portion 46 nearest end surface 50. As shown in FIG. 3, the end surface 50 in its retracted position corresponds with the location of the primary edge guide surface 48. However, depending upon the circumstances involved in a particular application, it may be desirable for the retracted position of end surface 50 to be further away from the edge of paper supply 38 than the primary edge guide surface 48.

Figure 5:
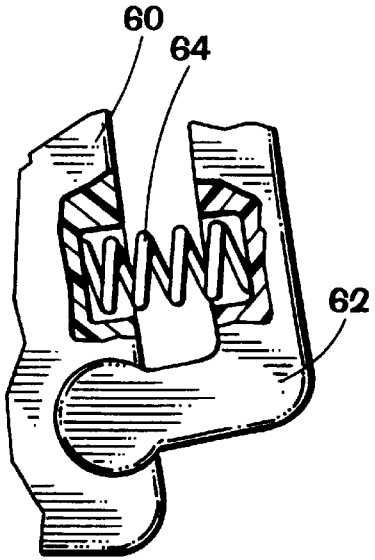
FIG. 5 is an illustration of a portion of an alternate embodiment of an edge guide in accordance with the present invention.

Although a side guide of one piece construction that includes a living hinge (as shown in FIGS. 3 and 4) is preferred, in accordance with the present invention alternate embodiments may be used depending upon the circumstances involved in a particular application. FIG. 5, for example, illustrates a portion of a side guide which is of two piece construction. The first portion 60 of the side guide is coupled in hinged relation to the second portion 62. A spring 64 or other suitable compliant member extends between the first and second portions 60, 62 so that the end surface (not shown) of the second portion 62 naturally tends to remain in a retracted position.

Operation is intuitive as a human operator necessarily grasps a flexible side or end guide when changing its position, and the force from that moves flexible portion 46, 62.

Figure 6:
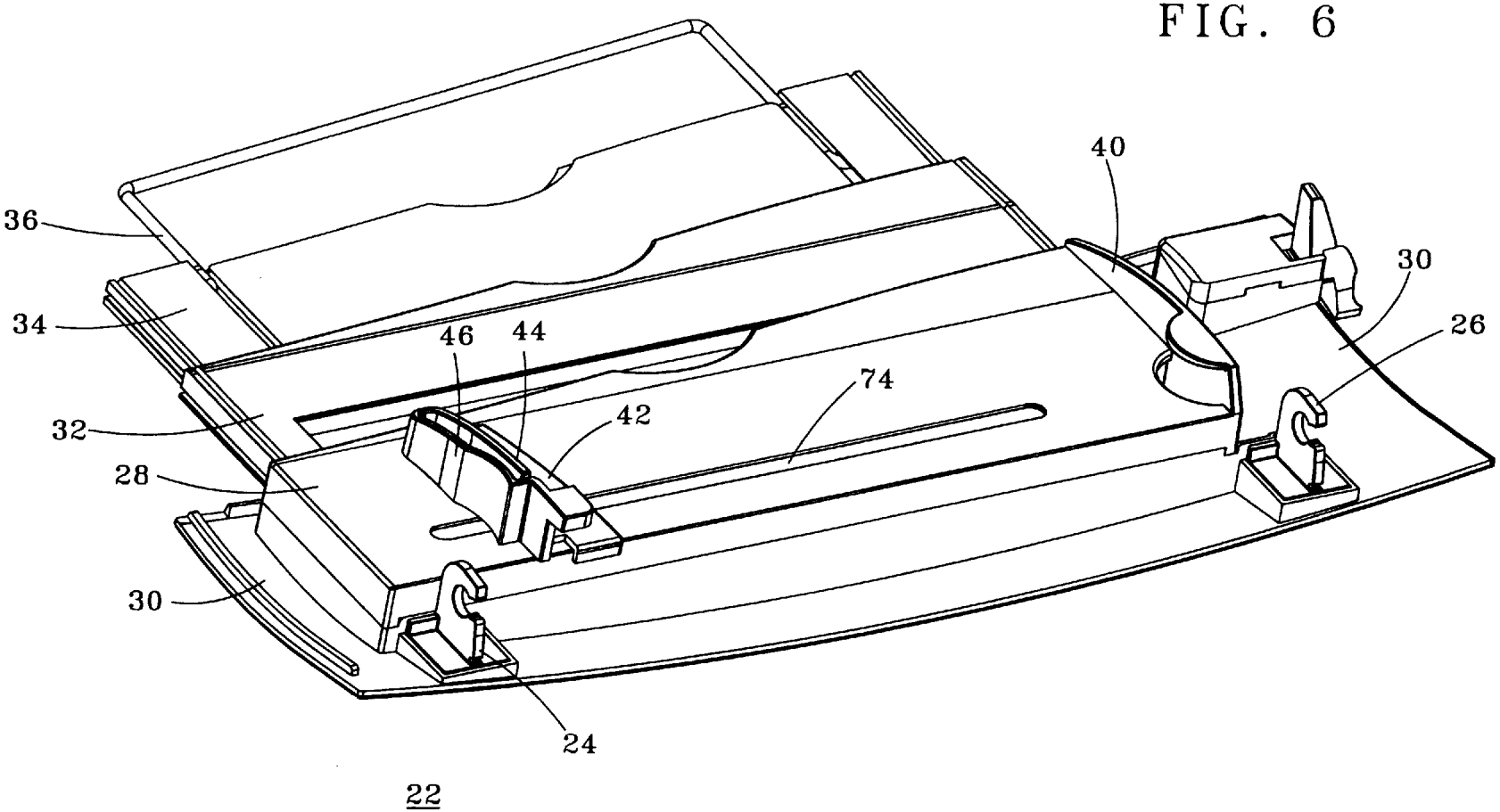
FIG. 6 is a view corresponding to FIG. 2 of a preferred embodiment. And, FIG. 7 is a view corresponding to FIG. 3 of the embodiment of FIG. 6.
Figure 7:
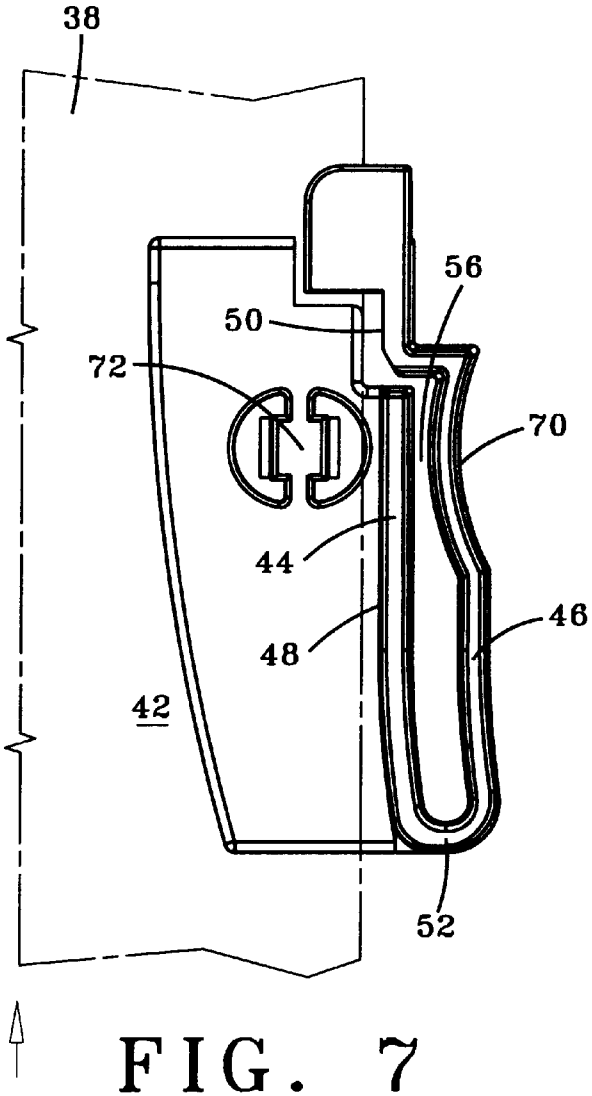

FIG. 6 is a view corresponding to FIG. 2 of a preferred embodiment of this invention. Corresponding elements in this embodiment are given the same number as those views of FIGS. 2–4. FIG. 7 is a top view of this preferred embodiment corresponding to FIG. 3. The guide surface 48 (FIG. 7) is straight in this embodiment so as to better receive paper. The second portion, 46 is more widely spaced from guide surface 48, to improve manufacturability as discussed immediately below. Flexible portion 46 has an inwardly curved section 70 spaced from hinge 52 which is a finger grip and movement limiter. Element 72 is the top of depending nub members (not shown) which resiliently holds a plate member (not shown) under main body 28 to provide friction sliding with the main body 28 with movement of the guide 42 along slot 74 (FIG. 6).

The side guide 42 shown in FIG. 7 is manufactured in high volume using an injection molding process with a thermoplastic as its material. The geometry of the part is such that the second portion 46 comprises a flexible cantilever member extending from the living hinge portion 52. An insert in the mold provides the spacing between portion 46 and guide surface 48, and an insert the size of the FIGS. 2–4 illustration would be delicate and difficult to use effectively. The spacing between portion 46 and guide surface 48 in the FIG. 7 embodiment is therefore larger.

The position of the end surface 50 is critical to the pinch-paper-location function and is determined by the width of the gap 56. Therefore, care must be taken during the manufacturing of the component in order to maintain a consistent width gap 56. During the injection molding process for the FIG. 7 embodiment, molten plastic is injected under high temperature and pressure into a cooler, steel mold. The part is allowed to cool for a short time in the mold and then ejected from the mold so the cycle can begin again. In order to minimize the molding cycle time, the part that is ejected from the mold is just cool enough to retain its shape, but still significantly warm. As the plastic cools, and depending on the geometry of the part, a part can have a tendency to warp due to the relieving of residual stresses from the molding operation. The cantilevered second portion 46 has this tendency to warp as it cools in such a manner that the width gap 56 becomes less than that desired.

One method of minimizing warping in a part is to allow the part a great deal of time to cool in the mold, but this is not desirable since the cost of molding press time is expensive. Rather a more desirable solution used for the FIG. 7 embodiments which shortens the in-mold time is to place the ejected warm part into a cooling fixture which has a physical insert which blocks collapse of width gap 56 as the part cools. The part is handled manually with gloves. By forcing the width gap 56 to be of the desirable dimension with a fixture as the part cools to room temperature, the residual stresses are relieved in a controlled manner and the desired width gap 56 is maintained. That blocking insert is a metal pin which is physically located during cooling at the end of curved section 70 away from hinge 52, although a blocking member at any place which by its physical presence prevents collapse would be effective.

Although the preferred embodiment of this invention has been described hereinabove in some detail, it should be appreciated that a variety of embodiments will be readily available to persons utilizing the invention for a specific end use. The description of the apparatus of this invention is not intended to be limiting on this invention, but is merely illustrative of the preferred embodiment of this invention. Other apparatus and methods which incorporate modifications or changes to that which has been described herein are equally included within this application. Additional objects, features and advantages of the present invention will become apparent by referring to the above description of the invention in connection with the accompanying drawings.

What is claimed is:

1. A paper source device, comprising:

a platform adapted to receive a supply of paper; and an adjustable side edge guide coupled to said platform, said adjustable side edge guide including a flexible cantilever portion for forming a temporary edge guide surface for use in adjusting the side edge guide relative to the supply of paper, said cantilever portion having an unbiased first position during operation of said paper source device, said cantilever portion also being selectively movable to a biased second position before operation of said paper source device, said second position defining a nonzero distance between said adjustable side edge guide and the supply of paper during operation of said paper source device.

2. The paper source device of claim 1 in which said adjustable side edge guide is plastic formed by injection molding and cooled after removal while warm from said injection molding while having a member physically blocking warp of said flexible cantilever portion toward the location of said temporary edge guide.

3. A paper source device as in claim 2 wherein said platform is a tray.

4. The paper source of claim 2, wherein said flexible cantilever portion of said edge guide includes an end surface movable between a first retracted position and a second extended position, said second extended position located between said edge guide surface and said supply of paper.

5. A paper source device as in claim 1 wherein said platform is a tray.

6. The paper source device of claim 1, wherein said adjustable side edge guide is a single part with said flexible cantilever portion comprising a flexible hinge.

7. The paper source device of claim 6, wherein said flexible cantilever portion of said edge guide includes an end surface movable between a first retracted position and a second extended position, said second extended position located between said edge guide surface and said supply of paper.

8. The paper source device of claim 1, wherein said means for adjusting the position of said edge guide surface relative to said supply of paper comprises an assembly hinged to said edge guide.

9. The paper source device of claim 8, wherein said assembly includes an end surface movable between first and second positions, said second position located between said edge guide surface and said supply of paper.

10. A paper source device, comprising:

a tray adapted to receive a supply of paper; and a side edge guide slidably coupled to said tray, said side edge guide including a primary guide surface and a cantilever portion including an end surface movable between an unbiased first position and a biased second position, said second position being further than said first position from said primary guide surface, said end surface second position spaced away from said primary guide surface, so that when said end surface is disposed in said second position and is brought to bear against said supply of paper, said primary surface is disposed away from said supply of paper.

11. The paper source device of claim 10 in which said adjustable side edge guide is plastic formed by injection molding and cooled after removal while warm from said injection molding while having a member physically blocking warp of said flexible cantilever portion toward the location of said temporary edge guide.

12. A paper source device, comprising:

a platform adapted to receive a supply of paper;

an edge guide coupled to said platform, said edge guide including an edge guide surface; and a flexible member for establishing clearance between said edge guide surface and said supply of paper, said flexible member being configured for pushing said supply of paper a predetermined distance away from said edge guide surface.

13. A method of positioning a supply of paper within a paper source device having a platform, comprising the steps of:

receiving the supply of paper on the platform of the paper source device;

coupling a side edge guide to the platform, said side edge guide having an edge guide surface and a cantilever portion;

biasing said cantilever portion of said side edge guide against the supply of paper to thereby push the supply of paper a predetermined distance away from said edge guide surface; and releasing said cantilever portion to thereby allow said cantilever portion to move away from the supply of paper.

14. The method of claim 13, comprising the further step of positioning the supply of paper and said edge guide surface in abutting relationship before said pushing step.

* * * * *